United States Patent [19]

Dreckmann

[11] Patent Number: 4,536,174

[45] Date of Patent: Aug. 20, 1985

[54] STACK CONVEYOR FOR BAG-MAKING APPARATUS

[75] Inventor: Karl Dreckmann, Hennef-Altenbödingen, Fed. Rep. of Germany

[73] Assignee: M. Lehmacher & Sohn GmbH Maschinenfabrik, Niederkassel-Mondorf, Fed. Rep. of Germany

[21] Appl. No.: 453,119

[22] Filed: Dec. 27, 1982

[30] Foreign Application Priority Data

Dec. 30, 1981 [DE] Fed. Rep. of Germany ..... 3151848

[51] Int. Cl.[3] ..... B65H 5/02

[52] U.S. Cl. ..... 493/194; 156/563; 493/204; 271/273; 271/274

[58] Field of Search ..... 493/194, 204; 271/273, 271/274; 226/186–187; 156/515, 182, 364, 563

[56] References Cited

U.S. PATENT DOCUMENTS 3,992,981 11/1976 Stock ..... 156/575 X
4,198,260 4/1980 Mundus et al. ..... 493/204 X

FOREIGN PATENT DOCUMENTS 2003553 8/1971 Fed. Rep. of Germany .

*Primary Examiner*—David Simmons

*Attorney, Agent, or Firm*—Karl F. Ross; Herbert Dubno

[57] ABSTRACT

An apparatus for making bags from a multilayer synthetic-resin strip workpiece has a transport device for conveying the workpiece longitudinally in a transport direction along a path, a lower welding tool along the path beneath the upper tool, and a heater for at least one of the tools. A conveyor belt extending along the path downstream of the tools has a horizontal conveyor surface positioned to receive the workpiece after same is conveyed by the transport device past the welding tools. A holddown roller rotatable about a horizontal axis is displaceable vertically above the conveyor surface. A drive connected to one of the welding tools and to the transport device, conveyor belt, and holddown roller generally synchronously vertically and codirectionally displaces the one welding tool and the holddown element and synchronously horizontally and codirectionally displaces the conveyor surface and holddown element. Thus the stack on the conveyor belt is pinched and engaged between the holddown element and conveyor surface. Thus any relative movement of the workpieces on the conveyor is impossible. During the critical phase when the conveyor is advanced the entire stack is positively engaged at the downstream end so there will be no slippage of the workpieces relative to one another.

6 Claims, 3 Drawing Figures

STACK CONVEYOR FOR BAG-MAKING APPARATUS

FIELD OF THE INVENTION

The present invention relates to a bag-making apparatus. More particularly this invention concerns a stacking conveyor for such an apparatus.

BACKGROUND OF THE INVENTION

An apparatus for making bags from a multilayer synthetic-resin strip workpiece, as described in my copending patent application Ser. No. 455,919 filed Jan. 6, 1983, has a transporter for conveying the workpiece longitudinally in a transport direction along a path. A vertically displaceable upper welding element along the path has an upper upstream welding tool extending across the path, an upper downstream welding tool generally parallel thereto, and a seat extending parallel to and between the two upper tools. A blade can be fitted in the seat of the tool element to project downward from the upper tools when in the seat. Respective heatable and vertically displaceable lower upstream and downstream welding tools are vertically aligned with the upper upstream and downstream tools. A stacker pin is movable in the lower downstream tool between a position beneath same to a position projecting above same. A bottom-seaming bar is displaceable between the lower tools between a position beneath same to a position projecting above same. The machine operates for double seaming by fitting the blade in the seat, positioning the pin and bar below the lower tools and heating the respective tools with the heating means. With the machine thus set the tools are displaced from the outer to the inner positions with the workpiece between them to pinch and weld the workpiece together along upstream and downstream seams at the respective tools and to cut the workpiece across with the blade between the seams. The machine operates for bottom seaming by removing the blade from the seat and raising the pin and bar above the lower tools. When thus set the tools are displaced from the outer to the inner positions with the workpiece between them to simultaneously cut the workpiece through and form two confronting end seams with the bar while pinching it to both sides of the bar and spindling it downstream of the bar on the pin.

A similar apparatus is described in my copending application Ser. No. 455,904 filed Jan. 6, 1983. It has a transporter for conveying the workpiece longitudinally in a transport direction along a path, an upper vertically displaceable welding element along the path having relative to the direction an upper upstream welding tool extending across the path and generally parallel thereto an upper downstream welding tool, and respective vertically displaceable lower upstream and downstream welding tools vertically aligned with the upper upstream and downstream tools. A blade extends transverse to the path between one of the upstream tools and the respective downstream tool. Displacement together of the tools with a workpiece between them welds the workpiece together along upstream and downstream seams at the respective tools and cuts the workpiece across with the blade between the seams, and away from one another frees the severed downstream end section of the workpiece. A stack support downstream of the tools catches and holds the severed end sections in a stack. This stack support is displaced in the transport direction synchronously with displacement of the tools for offsetting the trailing ends of succeeding severed end sections in the stack. Thus the offset ends of the bag-forming end sections do not lie on each other so they will not fuse together.

It is possible to use such an apparatus with an output or stacking conveyor such as described in German patent document 2,003,553 filed Jan. 27, 1970 by R. Feldkamper or in U.S. Pat. No. 3,911,800 to form so-called shingled stacks of the bags. In such a stack the workpieces have lateral edges parallel to the transport direction and in vertical registration with the lateral edges of the underlying workpiece and leading and trailing edges perpendicular to the transport direction and that trail the leading and trailing edges of the underlying workpiece. This shingled arraying is advantageous when the workpieces have fresh welds that are still hot, as it keeps the welds apart so they do not fuse together.

A problem with such a conveyor, particularly when it is working with bags made of a relatively thick thermoplastic sheet, is that the workpieces shift relative to each other as they are transported. This is due to the small coefficient of sliding friction effective between the workpiece and is particularly troublesome at the upstream or intake end of the stacking conveyor where the workpieces have only partial contact with an underlying workpiece or with the conveyor surface.

OBJECTS OF THE INVENTION

It is therefore an object of the present invention to provide an improved bag-making apparatus.

Another object is the provision of an improved stacking conveyor for a bag-making apparatus which overcomes the above-given disadvantages.

SUMMARY OF THE INVENTION

These objects are attained according to the instant invention in an apparatus for making bags from a multilayer synthetic-resin strip workpiece which has transport means for conveying the workpiece longitudinally in a transport direction along a path, a lower welding tool along the path beneath the upper tool, and means for heating at least one of the tools. Conveyor means extending along the path downstream of the tools has a horizontal conveyor surface positioned to receive the workpiece after same is conveyed by the transport means past the welding tools. Holddown means including a movable holddown element is displaceable vertically and at least partially horizontally above the conveyor surface. Drive means connected to one of the welding tools and to the transport, conveyor, and holddown means generally synchronously vertically and codirectionally displaces the one welding tool and the holddown element and synchronously horizontally and codirectionally displaces the conveyor surface and holddown element.

With this system, therefore, the stack is pinched and engaged between the holddown element and conveyor surface. Thus any relative movement of the workpieces on the conveyor is impossible. During the critical phase when the conveyor is advanced the entire stack is positively engaged at the downstream end so there will be no slippage of the workpieces relative to one another.

According to another feature of this invention the holddown element is a vertically displaceable roller rotatable by the drive means at a peripheral speed equal to the displacement speed of the conveyor surface. In addition the drive means includes at least one upright shaft, a mount carrying the roller and vertically displaceable on the shaft, a spring braced between the mount and the shaft, and motor means for vertically reciprocating the shaft generally synchronously with the one welding tool. This the motor means includes a crank. Such a drive is extremely simple and ensures that as the stack varies in height the holddown roller will be urged resiliently against it.

In accordance with another feature of this invention the drive means includes a rotatable drive wheel jointly vertically displaceable with the roller and operatively engageable with the conveyor surface. Thus when engaging the conveyor surface the drive wheel is rotated thereby. An endless drive member—a chain or belt—looped over the wheel and over the roller transmits the rotation of the drive wheel to the drive roller. The drive wheel and roller are so dimensioned that, as mentioned above, the peripheral speed of the roller is exactly equal to the advance speed of the conveyor surface.

The drive means according to this invention also has an arm having one end pivoted on the axis of the roller and another end carrying the wheel and spring means urging the wheel downward relative to the roller. This ensures good force transmission between the wheel and the conveyor element driving it. This conveyor element is an endless belt having a horizontal upper stretch constituting the conveyor surface. At its upstream end it is spanned over a drive roller that projects horizontally past it and at this projecting end is engageable with the wheel that drives the holddown roller.

DESCRIPTION OF THE DRAWING

The above and other features and advantages will become more readily apparent from the following, reference being made to the accompanying drawing in which.

SPECIFIC DESCRIPTION

Figure 1:
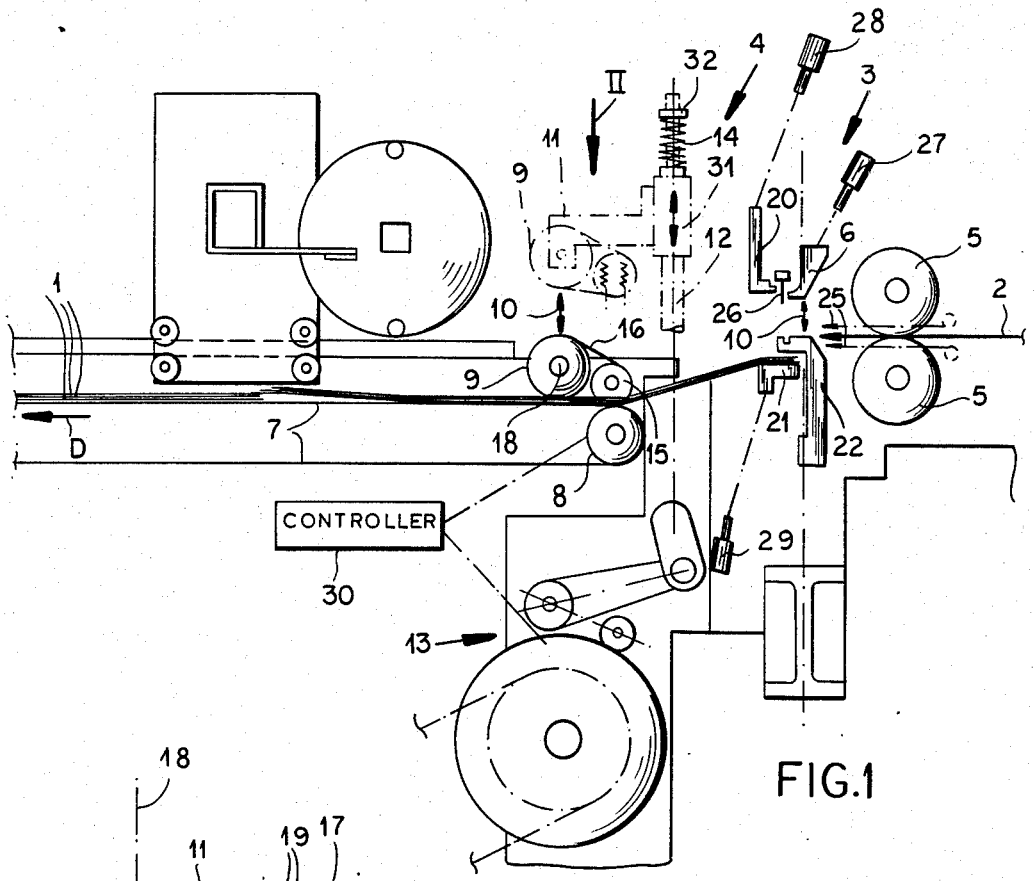
FIG. 1 is a side partly schematic view of the apparatus according to this invention.

As seen in FIG. 1, bags 1 are cut from a multilayer synthetic-resin strip workpiece 2, here a polyethylene tube. This tube 2 is formed with a transverse seam or weld and is cut transversely across in a unit 3 and then is formed into a shingled overlapping stack in a unit 4.

To this end a pair of rollers 5 and a pair of slot-type air nozzles 25 move the tube 2 in a transport direction D. The foil, film, or sheet forming the tube 2 is light enough to assume a perfectly horizontal position downstream of the rollers 5, supported only by the air streams.

The welding/cutting unit 3 comprises a transversely throughgoing upstream tool 6 and a downstream clamp or tool 20. Between the tools 6 and 22 is provided a blade 26 that projects down between and beneath the lower faces of the tools 6 and 20. Respective drivers 27 and 28 can raise and lower the tools 6 and 20 independently of each other.

Underneath the upper tools 6 and 20 the apparatus is provided with independent upstream and downstream lower tools 22 and 21. At least the upstream tools 6 and 22 are provided with heaters and all of them may thus be made heatable as described in the second above-cited patent application to which reference should be made for specifics. The tool 2 can be stationary or strongly upwardly spring biased and the tool or clamp 21 has a respective actuator 21 that moves it vertically oppositely to the clamp or tool 20.

The stacker according to this invention comprises a conveyor band or belt 7 whose upstream stretch moves in the direction D while lying in a horizontal plane somewhat below the horizontal plane in which the workpiece 2 lies when between the upper tools 6 and 20 and lower tools 21 and 22. Drive means including a roller 8 is operated by a controller 30 which also operates the actuators 27–29 and the drive roller 5 to advance this belt 7 stepwise, that is indexing it a small increment equal to a fraction of a bag length each time the unit 3 operates as will be described below. Every ten or so indexings of the belt 7 it can be stepped a greater increment to form individual overlapping piles with the bags 1 shingled within the piles as illustrated in FIG. 1.

According to the invention positive transport, that is transport while being gripped on both sides with elements that move at the same speed in the same direction, is ensured by engaging the top of the bag or bags 1 on the belt 7 with a roller 9 centered on a horizontal axis 18 and movable vertically as indicated by arrow 10. To this end the roller 9 is journaled on arms 11 each extending from a collar 31 vertically slidable on a vertical shaft 12 whose upper end carries a snap ring 32 acting as abutment. A compression spring 14 is connected between the abutment ring 32 and the sleeve 31 so this arm 11 and the roller 9 move with the shaft 12 but can also move limitedly vertically relative thereto. A crank drive 13 also operated by the controller 30 vertically reciprocates these shafts 12.

Figure 2:
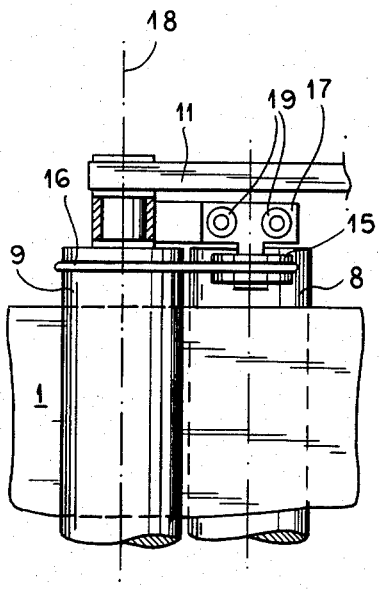
FIG. 2 is a top view of the detail indicated at II in FIG. 1.

In order that the peripheral speed of the roller 9 is identical to the travel speed of the belt 7, a belt 16 best seen in FIG. 2 is looped over the one end of the roller 9, beyond where it is engaged by the bags 1. The other end of this belt 16 is looped over a roller 15 carried on an arm 17 pivotal about the axis 18 and urged downward by springs 19 braced against the arm 11. Thus as the shafts 12 are moved down first the roller or rollers 15 engage the roller 8, then the roller 9 engages the top of the bag or pile of bags on the belt 7, bearing down on it with a force determined by the spring 14. Whenever the driver roller 8 rotates, the roller 9 will therefore rotate at a peripheral speed identical to that of the belt 7.

The system of this invention functions as follows:

The rollers 5 advance a length of the workpiece 2 through the unit 3 equal to the desired bag length. Then the upper tools 6 and 20 move down and the lower tool 21 rises until the tools 6 and 20 pinch the workpiece 2 against the tools 21 and 22, and generally simultaneously the blade 26 engages the workpiece 2. This forms a weld seam between the tools 6 and 22 and cuts the workpiece completely through immediately downstream from it. During this operation the roller 9 moves from the upper dot-dash position seen in FIG. 1 to a position engaging on top of the leading end of the workpiece 2, all the time without the belt 7 moving.

Immediately after the workpiece 2 is severed the tools 20 and 21 drop down to pull the trailing end of the severed bag 1 off the tool 22. Then the tool 20 lifts and the drive roller 8 rotates a short angular increment to pull the just cut bag downstream an increment equal to a small fraction of its length. The simultaneous codirectional movement of the belt 7 and roller 9 insures that the pile of bags 11 will be displaced without slippage.

Figure 3:
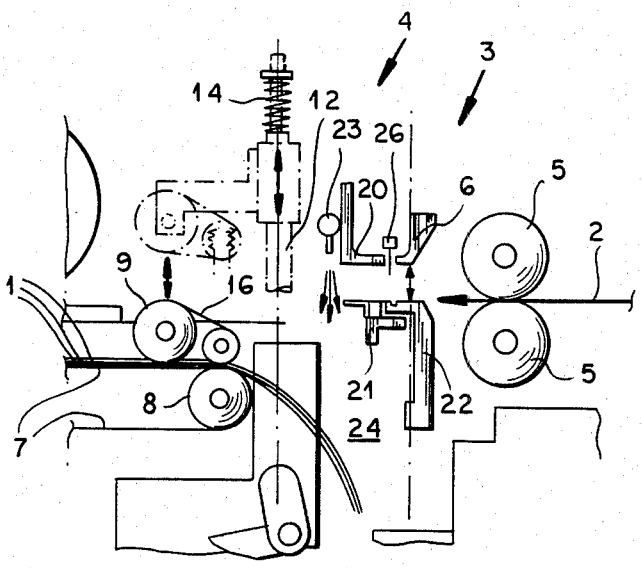
FIG. 3 is a view like FIG. 1 showing another apparatus according to this invention.

It is also possible for the system to operate in a manner similar to that described in the first above-citedd patent application to which reference should be made for more specifics. This general type of arrangement is shown in FIG. 3. Here a downwardly directed compressed air nozzle 23 can deflect the trailing ends of the bags 1 into a space 24 defined between the unit 3 and the unit 4. The controller 30 operates this nozzle 23 to emit a sharp blast of air as soon as the tool 20 releases the just severed workpiece and as the belt 7 and roller 9 start to move to free the bag 1 from the unit 3.

The arrangement according to this invention allows the bags 1 to be stacked up in neat shingled piles, that is with their lateral edges extending parallel to the direction D in vertical registration but the leading and trailing edges of each bag 1 somewhat trailing the leading and trailing edges of the underlying bag 1. Since the top bag and bottom bag of the pile or stack on the belt 7 is positively engaged, slippage within the stack is impossible.

I claim:

1. An apparatus for making bags from a multilayer synthetic-resin strip workpiece, the apparatus comprising:

transport means for conveying the workpiece longitudinally in a transparent direction along a path;

an upper welding tool along the path;

a lower welding tool along the path beneath the upper tool;

means for heating at least one of the tools;

conveyor means extending along the path downstream of the tools and having a horizontal conveyor surface positioned to receive the workpiece after same is conveyed by the transport means past the welding tools;

holddown means including a movable holddown element displaceable vertically and at least partially displaceable horizontally above the conveyor surface; and drive means connected to one of the welding tools and to the transport, conveyor, and holddown means for generally synchronously vertically and codirectionally displacing the one welding tool and the holddown element and for synchronously horizontally and codirectionally displacing the conveyor surface and holddown element, the holddown element being a vertically displaceable roller rotatable by the drive means at a peripheral speed equal to the displacement speed of the conveyor surface, said drive means including:

a rotatable drive wheel jointly vertically displaceable with the roller and operatively engageable with the conveyor surface, whereby when engaging the conveyor surface the drive wheel is rotated thereby; and an endless drive member looped over the wheel and over the roller.

2. The bag-making apparatus defined in claim 1 wherein the conveyor surface is an endless belt having a horizontal upper stretch constituting the conveyor surface.

3. The bag-making apparatus defined in claim 1 wherein the drive means includes at least one upright shaft;

a mount carrying the roller and vertically displaceable on the shaft;

a spring braced between the mount and the shaft; and motor means for vertically reciprocating the shaft generally synchronously with the one welding tool.

4. The bag-making apparatus defined in claim 3 wherein the motor means includes a crank.

5. The bag-making apparatus defined in claim 1 wherein the drive means further includes an arm having one end pivoted on the axis of the roller and another end carrying the wheel.

6. The bag-making apparatus defined in claim 5 wherein the drive means further includes spring means urging the wheel downward relative to the roller.

* * * * *